United States Patent [19]

Miyake et al.

[11] 4,265,662

[45] May 5, 1981

[54] HARD ALLOY CONTAINING MOLYBDENUM AND TUNGSTEN

[75] Inventors: Masaya Miyake; Minol Nakano; Takaharu Yamamoto; Akio Hara, all of Itami, Japan

[73] Assignee: Sumitomo Electric Industries, Ltd., Japan

[21] Appl. No.: 971,835

[22] Filed: Dec. 19, 1978

[30] Foreign Application Priority Data

| | | | |
|---|---|---|---|
| Dec. 29, 1977 | [JP] | Japan | 52-159298 |
| Jan. 18, 1978 | [JP] | Japan | 53-4703 |
| Feb. 8, 1978 | [JP] | Japan | 53-13894 |
| Feb. 24, 1978 | [JP] | Japan | 53-21371 |
| Feb. 28, 1978 | [JP] | Japan | 53-23237 |
| Mar. 10, 1978 | [JP] | Japan | 53-28014 |

[51] Int. Cl.[3] ..... B22F 3/00

[52] U.S. Cl. ..... 75/238

[58] Field of Search ..... 75/238, 241, 242

[56] References Cited

U.S. PATENT DOCUMENTS

| | | | |
|---|---|---|---|
| 4,049,380 | 9/1977 | Yih et al. | 75/203 |
| 4,049,876 | 9/1977 | Yamamoto et al. | 75/204 |

OTHER PUBLICATIONS

*Lange's Handbook of Chemistry* 11th Ed. (1973) pp. 4–139.

*Primary Examiner*—Brooks H. Hunt

*Attorney, Agent, or Firm*—Wenderoth, Lind & Ponack

[57] ABSTRACT

This invention relates to a hard alloy comprising a hard phase consisting of at least one compound having a crystal structure of simple hexagonal MC type (M: metal; C: carbon) selected from the group consisting of mixed carbides, carbonitrides and carboxynitrides of molybdenum and tungsten as a predominant component, and a binder phase consisting of at least one element selected from the group consisting of iron, cobalt, nickel and chromium, in which a hard phase consisting of a compound of $M_2C$ type having a crystal structure of hexagonal type is evenly dispersed.

16 Claims, 6 Drawing Figures

HARD ALLOY CONTAINING MOLYBDENUM AND TUNGSTEN

BACKGROUND OF THE INVENTION

1. FIELD OF THE INVENTION

This invention relates to a hard alloy containing molybdenum and a process for the production of the same and more particularly, it is concerned with a hard alloy comprising, as a predominant component, a hard phase consisting of a compound having a crystalline structure of simple hexagonal type and a process for the production of the same.

2. DESCRIPTION OF THE PRIOR ART

Up to the present time, as a starting material for cemented carbides, there has been used tungsten carbide (WC) powder as a predominant component with a suitable binder metal, typically an iron group metal, to which carbides or carbonitrides of high melting point metals such as titanium (Ti), tantalum (Ta), niobium (Nb), molybdenum (Mo), hafnium (Hf), vanadium (V) and chromium (Cr) are added depending upon the requirements of a desired alloy. However, it is also true that tungsten is a relatively expensive metal and that it is found in only a few parts of the world. Accordingly, it is considered to be a so-called "strategic" material, and its availability can be subject to political considerations. Therefore, increase of the demand for cemented carbides consisting of tungsten carbide almost inevitably presents problems of availability and if the tungsten carbide can be exchanged for another high melting point metal carbide, this exchange would have a great influence upon the industry.

Molybdenum monocarbide (MoC) is considered as a useful substitute, since this carbide only has the same crystal structure of simple hexagonal type as tungsten carbide as well as mechanical properties similar to tungsten carbide. However, the existence of the hexagonal molybdenum monocarbide as a simple substance has remained in question to this date and thus an attempt to stabilize molybdenum monocarbide has exclusively been carried out by forming a solid solution with tungsten carbide. This method was first reported by W. Dawihl in 1950, but this solid solution was not examined in detail and its commercial value was not found in those days.

Of late, however, the study to utilize the solid solution $(Mo_xW_y)C$ wherein $x+y=1$ has become active with the rise of the price of tungsten. It is very interesting why a study on this solid solution and an attempt to use the same has not been carried out so actively up to the present time.

Molybdenum carbide is stabilized as a monocarbide having a crystal structure of simple hexagonal type when a solid solution is formed with tungsten carbide. If this stable carbide of (Mo, W)C can readily be prepared, replacement of tungsten by molybdenum would be possible. For the embodiment of this purpose, there has been proposed a process for the stable production of (Mo, W)C (Japanese Patent Application OPI No. 146306/1976- U.S. Pat. No. 4,049,380-). When the (Mo, W)C powder obtained by this process is used as a starting material of a (Mo, W)C-CO alloy as a substitute for WC, however, MoC is not stable in the alloy and $Mo_2C$ tends to precipitate often. Furthermore, this process has not been put to practical use, since it requires a heat treatment for a long time.

Furthermore, it has been proposed to produce a molybdenum-tungsten carbonitride having a crystalline structure of tungsten carbide by heating molybdenum and tungsten in combined form and carbon in a proportion sufficient to form the monocarbide in a nitrogen-containing atmosphere (Japanese Patent Application (OPI) No. 104617/1978.). However, this method seeks to stabilize the alloy by incorporating nitrogen so that $(Mo, W)_2C$ is not precipitated.

SUMMARY OF THE INVENTION

It is an object of the present invention to provide a hard alloy containing molybdenum.

It is another object of the present invention to provide a hard alloy corresponding to a cemented carbide alloy consisting mainly of tungsten carbide (WC) a part of which is replaced by molybdenum carbide (MoC).

It is a further object of the present invention to provide an alloy having a hard phase consisting of a hexagonal monocarbide of (Mo, W)C in which $(Mo, W)_2C$ is dispersed.

It is a still further object of the present invention to provide a hard alloy having a hard phase consisting of a compound of tungsten and molybdenum with carbon, nitrogen and oxygen, having a crystal structure of simple hexagonal type.

These objects can be attained by a hard alloy comprising a hard phase consisting of a compound of (Mo, W)C of simple hexagonal type and a binder phase consisting of at least one element selected from the group consisting of iron, cobalt, nickel and chromium, in which a compound represented by $(Mo, W)_2C$ having a crystal structure of hexagonal type is uniformly dispersed as a hard phase.

BRIEF DESCRIPTION OF THE DRAWING

The accompanying drawings are to illustrate the principle and merits of the present invention in more detail.

DETAILED DESCRIPTION OF THE INVENTION

In accordance with the present invention, there is provided of a hard alloy comprising a hard phase consisting of at least one compound of simple hexagonal MC type (M: metal; C:carbon) selected from the group consisting of mixed carbides, carbonitrides and carbooxynitrides of molybdenum and tungsten as a predominant component, and a binder phase consisting of at least one element selected from the group consisting of iron, cobalt, nickel and chromium, in which a hard phase consisting of a compound of $M_2C$ type having a crystal structure of hexagonal type is evenly dispersed. The quantity of the compound of $M_2C$ type precipitated in preferably 30% by volume or less, in particular, 5 to 25% by volume, since if more than 30% by volume, $M_2C$ grows to large particles such that the objects or effects as a dispersed strengthened alloy cannot be achieved. As an essential condition for dispersing evenly the hard phase of $M_2C$ type, it is necessary that the carbon content of the hard phase is in an atomic proportion of 0.98 to 0.80 to the theoretical carbon content of the hard phase of MC type.

Briefly stated, and in accordance with the presently preferred embodiment of the invention, there is provided a hard alloy which comprises one or more carbide phases consisting of 80% by weight or more of a carbide of MC type, solid solution containing molybdenum and tungsten and having a crystal structure of simple hexagonal type and 20% by weight or less of a mixed carbide of $M_2C$ type containing, as a main component, $Mo_2C$ and having a granular or globular shape with a size of 10 microns or less, the carbide of $M_2C$ type being dispersed in the alloy, and 3 to 50% by weight of a binder phase consisting of an iron group metal.

Figure 1:
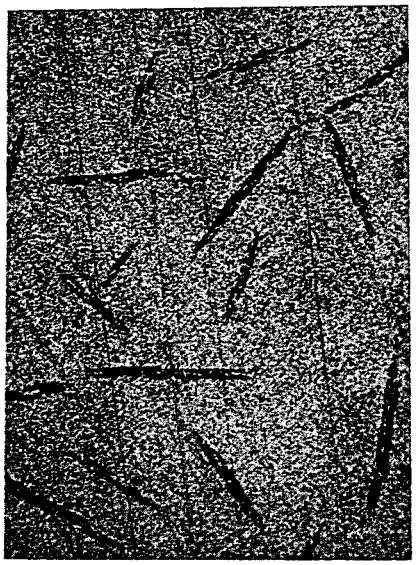
FIG. 1 is a micrograph, magnified 200 times, of a prior art cemented carbide alloy containing molybdenum, showing the appearance of a carbide of (Mo, $W)_2C$ type precipitated needlewise.
Figure 2:
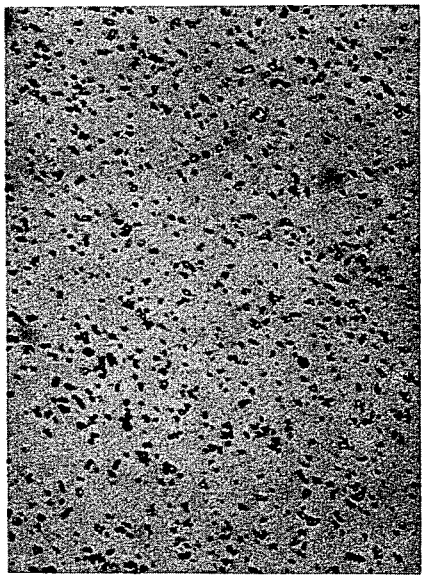
FIG. 2 is a micrograph, magnified 200 times, of a (Mo, W)C-(Mo, $W)_2C$-Co alloy according to the present invention, in which a carbide of (Mo, $W)_2C$ type is uniformly dispersed.
Figure 3:
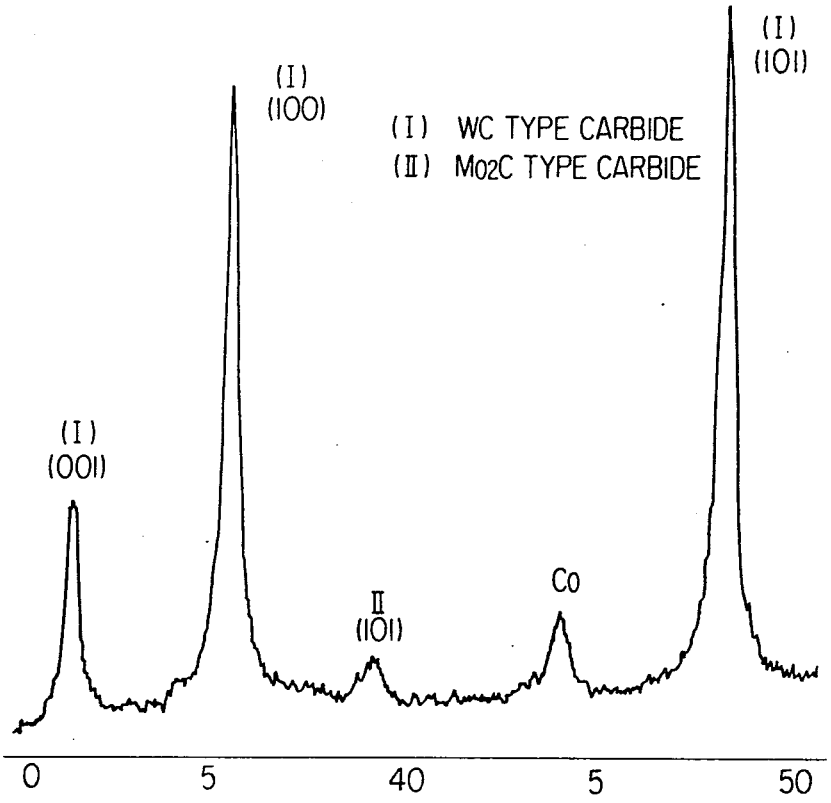
FIG. 3 is an X-ray diffraction pattern of an alloy of the present invention.

The inventors have made various studies mainly on the relation between the carbon content and the toughness of a cemented carbide alloy from $(Mo_xW_y)C$ as a starting material and consequently, have found the following facts:

When the carbon content of the alloy is less than the theoretical carbon content, a molybdenum-tungsten mixed carbide of $M_2C$ type precipitates as needle crystals as in the prior art (FIG. 1). When the alloy contains a micro quantity of an impurity element, on the other hand, the mixed carbide is not of needle crystals, but it precipitates in a finely granular form (FIG. 2). It is found as a result of measurement of the strengths of the alloy containing needle-shaped molybdenum-tungsten mixed carbide of $M_2C$ type precipitated and the alloy containing granular mixed carbide of $M_2C$ type that the latter is superior to the former in toughness. It is well known that the strength of such an alloy depends to a great extent on the difference of precipitated forms as described above. In the former case, a stress is concentrated on needle crystals of molybdenum-tungsten mixed carbides ($M_2C$, $M_3C_2$) resulting in starting points of breakage and in lowering of the strength of the alloy, while the latter is a so-called dispersed type alloy, in which granular molybdenum-tungsten carbides of $M_2C$ type are evenly or widely dispersed so that the stress concentration on the mixed carbides is prevented and an external force added to the alloy is rather absorbed, thus increasing the strength of the alloy.

The reason why the granular crystals of molybdenum-tungsten mixed carbide of $M_2C$ precipitate is not clear in detail, but can be considered to be as follows:

In an ordinary (Mo, W)C alloy, precipitation of the needle crystals of molybdenum-tungsten mixed carbide of $M_2C$ type is due to that the precipitation temperatures of tungsten and molybdenum are different in the cooling step of the liquid phase in which tungsten, molybdenum and carbon are dissolved in the binder phase. That is to say, WC precipitates at a relatively high temperature and only Mo and C remain in the binder phase to the end. At a temperature of lower than 1180° C., MoC is decomposed into $Mo_2C$ and C and thus $Mo_2C$ remain as an agglomerate. The free carbon and $Mo_2C$ precipitated can be well dispersed by a rapid cooling treatment so as to prevent them from agglomeration. However, this method can with a sufficient cooling effect be adapted to a small body of alloy having a small thermal capacity, but it is difficult to treat a large body of cemented carbide alloy having a large thermal capacity by this method.

The inventors have found as a result of X-ray diffraction analysis of the binder phase of an alloy in which needle $Mo_2C$ is precipitated that the lattice constant of the binder phase is not changed from that of the pure metal and the binder phase is not alloyed, nor embrittled. Thus, it is assumed that if a needle-shaped $Mo_2C$ precipitated can be dispersed in a granular or globular form, an alloy having a sufficient strength can be prepared. If there are micro amounts of impurity elements in the binder phase, Mo, W and C are combined on nuclei of such elements to form or precipitate a number of nuclei of $M_2C$ type molybdenum-tungsten mixed carbide before the liquid phase vanishes or solidifies and Mo and C are not in the binder phase. Thus, there is no precipitation of needle crystals of $M_2C$ type even at a temperature of 1180° C. or less at which the liquid phase vanishes. In general, the precipitate of a large number of $M_2C$ nuclei is in a globular or rod-like form and, in order to disperse and precipitate more finely the molybdenum-tungsten mixed carbide of $M_2C$ type in the alloy, it is effective to inhibit the precipitation and growth of the molybdenum-tungsten mixed carbide of $M_2C$ type by subjecting to rapid cooling from the sintering temperature to the solidification temperature of liquid phase.

For the purpose of dispersing evenly the $M_2C$ phase in the alloy, there are a method comprising first preparing a carbide $(Mo, W)_2C$, adding the carbide to the starting powders to be mixed and controlling the sintering conditions to precipitate uniformly $(Mo, W)_2C$ phase, a method comprising, during the step of producing a carbide, synthesizing not only a complete solid solution of (Mo, W)C but also a carbide in the surface layer of which fine $(Mo, W)_2C$ is dispersed, adding an iron group metal such as Co, Ni or Fe to the carbide and sintering the mixture with precipitation of $(Mo, W)_2C$ and a method comprising adding Mo and W to a carbide of (Mo, W)C and thus precipitating Mo and W dissolved in the binder phase as $(Mo, W)_2C$ during the sintering step.

Furthermore, the inventors have made studies on the conditions for dispersing $(Mo, W)_2C$ in the alloy and consequently, have found that a micro amount of one or more impurity elements is added to the alloy and the $M_2C$ phase is precipitated round the impurity nuclei in the steps of sintering and cooling, thereby dispersing the $M_2C$ phase uniformly in a globular form. In particular, during formation of the carbide, an impurity element can be added and dispersed uniformly. Impurities such as iron are effective for promoting the carburization reaction and $Fe_3C$ formed at this time serves as nuclei to disperse $(Mo, W)_2C$. When the impurity is not added, a needle-like $M_2C$ phase tends to precipitate as a primary crystal. In order to prevent this precipitation, it is necesary to control the quantity of Mo and W dissolved during sintering. To this end, the quantity of W dissolved in the binder metal is increased more than that of Mo thereby precipitating uniform $(Mo, W)_2C$.

Examples of the element added as an impurity element to the binder metal are one or more of beryllium, magnesium, calcium, boron, silicon, phosphorus, manganese, iron and rhenium. These elements are added individually or in combination to the binder metal in a proportion of at most 3% by weight, since if more than 3% by weight, the molybdenum-tungsten mixed carbide of $M_2C$ phase is embrittled and the strength is not so increased. Addition of titanium, zirconium, hafnium, tantalum and niobium as an element to inhibit the precipitation and growth of the molybdenum-tungsten mixed carbide of $M_2C$ type is also effective for the dispersed precipitation of the mixed carbide.

The carbide or mixed carbide of $M_2C$ mentioned in this specification includes not only $(Mo, W)_2C$ and $(Mo, W)_3C_2$ but also other lower carbides containing other metals.

The size of the granular precipitate, molybdenum-tungsten mixed carbide of $M_2C$ type is preferably 0.1 to 10 microns, more effectively 1.0 to 2 microns, since if the precipitated particles are too coarse, the strength and hardness of the alloy are lowered, while if too small, the mixed carbide is deposited on the boundary of (Mo, W)C or binder phase thereof, so that the boundary strength is is lowered and thus the alloy strength is deteriorated. The quantity of carbon when a carbide of $M_2C$ type is dispersed in the alloy is preferably 80 to 98% of the theoretical quantity when all the carbides are regarded as of MC type. This corresponds to the presence of 2 to 30% by volume.

A granular or globular molybdenum-tungsten mixed carbide of $M_2C$ phase has a large influence upon the property of the alloy depending on the quantity of the mixed carbide. X-ray diffraction using CuK$\alpha$, under conditions of 40 KV, 80 mA, FS 4000 c/s and TC 0.2 sec shows that the alloy has properties at least similar to those of WC-Co alloys when the ratio of the X-ray peak of $M_2C$ type to the peak of MC type appearing near 39.4° and 48.4° in the X-ray diffraction angle (2 $\theta$) is in the range of 0.01 to 0.5, in particular, 0.05 to 0.20. In this specification, for the convenience of illustration, the molybdenum-tungsten mixed carbide of $M_2C$ type is sometimes represented by $M_2C$ or $Mo_2C$, but, even though W, Co, Ni, N and/or O are dissolved in $M_2C$ or $Mo_2C$ and the ratio of the metallic components and non-metallic components is fluctuated near 2:1, the effects or merits of the present invention are not lost.

As a binder metal there is preferably used an iron group metal in a proportion of 3 to 50% by weight based on the alloy composition, since if less than 3% by weight, the alloy is brittle and if more than 50% by weight, the high temperature property is deteriorated. The iron group metal as a binder phase can naturally dissolve Group IVa, Va and VIa metals and it is possible to add even other elements having solubility therein such as aluminum, silicon, calcium, silver, etc. while realizing the merits of the present invention.

The basic concept of the present invention can be realized even when a part of molybdenum and tungsten carbide is replaced by a B1 type mixed carbide containing titanium, zirconium, hafnium, vanadium, niobium, tantalum, chromium, molybdenum and/or tungsten in a proportion of 30% by weight or less, preferably 0.5 to 25% by weight. Furthermore, there is the similar relationship even in the case of an alloy wherein a part of C in the carbide is replaced by nitrogen and/or oxygen. Examples of the preferred embodiment in this case are as follows.

The first embodiment is incorporation of N in (W, Mo)C to give (W, Mo)(C, N) whereby a stable starting material of hexagonal WC type can be obtained without a heat treatment for a long time.

The second embodiment is incorporation of O in (W, Mo)(C, N) to give (W, Mo)(C, N, O) which is more stable.

The third embodiment is incorporation of Cr in (W, Mo)(C, N) or (W, Mo)(C, N, O) to give (W, Mo, Cr)(C, N) or (W, Mo, Cr)(C, N, O) whereby a starting material with a low weight and low price can be obtained.

The fourth embodiment is that in the production of these starting material powders, a mixture of oxides, metals, carbides and/or carbon is exposed to an atmosphere having a nitrogen partial pressure of 300 Torr or more at a temperature of 700° C. or higher in a part of the carburization step to form a stable starting powder.

The fifth embodiment is that, when the above described starting powder is combined with an iron group metal, two or more kinds of hard phases of simple hexagonal WC type differing in composition are caused to be present in the finished alloy, thereby imparting a high toughness thereto.

In these five embodiments, a part of the MC type phase can also be replaced by a B1 type solid solution containing one or more of Group IVa, Va and VIa metals and non-metallic elements, or the ordinary additives to cemented carbides, such as silver, silicon, bismuth, copper, aluminum, etc. can also be added to the iron group binder metal while realizing the merits of the present invention.

The above described embodiments will now be illustrated in greater detail:

In the important system of the present invention wherein there are a simple hexagonal phase containing molybdenum and tungsten and an $M_2C$ phase, it is found in the sintered alloy with a binder metal that, when $$A = \left(\frac{N \text{ atom } \%}{(Mo + W) \text{ atom } \%}\right) \times \left(1 - \frac{W \text{ atom } \%}{(Mo + W) \text{ atom } \%}\right),$$

the suitable range of A is $0.005 \leqq A \leqq 0.5$. If A is less than the lower limit, the effect of nitrogen does not appear, while if more than the upper limit, sintering to give excellent properties is difficult. The most suitable range of A is $0.01 \leqq A \leqq 0.4$.

Concerning the effect of oxygen, it is found that, when $$B = \left(\frac{O \text{ atom } \%}{(Mo + W) \text{ atom } \%}\right) \times \left(1 - \frac{W \text{ atom } \%}{(Mo + W) \text{ atom } \%}\right),$$

the suitable range of B is $0.005 \leqq B \leqq 0.05$. If B is less than the lower limit, there is no favourable effect of oxygen, while if more than the upper limit, sintering is difficult to give excellent properties. The most suitable range of B is $0.01 \leqq B \leqq 0.04$.

On the other hand, the W/Mo ratio is preferably 5/95 to 90/10, since if less than 5/95, the alloy is unstable, while if more than 90/10, the merits of the replacement (light weight, low price) are substantially lost. The quantity of chromium used for replacing molybdenum or tungsten is 0.5 or less by atomic ratio of (W+Mo), since if more than 0.5, the alloy is brittle although the corrosion resistance is increased.

As well known in the art, it is advantageous for cutting tools, to form a B1 type solid solution composed of at least one of Group IVa, Va and VIa metals such as titanium, zirconium, hafnium, vanadium, tantalum, chromium, molybdenum and tungsten with at least one of non-metallic components such as carbon, nitrogen and oxygen in addition to the simple hexagonal phase. The quantity of the B1 type solid solution is preferably changed depending upon the cutting use.

Concerning the quantity of nitrogen in this case, it is found as a result of our various experiments that, when the definition of A is changed to $$\left(\frac{N \text{ atom } \%}{\text{Group IVa, Va, VIa metals atom } \%}\right) \times \left(1 - \frac{W \text{ atom } \%}{\text{Group IVa, Va, VIa metals atom } \%}\right),$$

the suitable range of A is also $0.005 \leqq A \leqq 0.5$ although a part of the nitrogen is occluded in the B1 type solid solution. The optimum range of A is $0.01 \leqq A \leqq 0.4$. Concerning the quantity of oxygen, it is found as a result of our various experiments that, when the definition of B is changed to $$\left(\frac{O \text{ atom } \%}{\text{Group IVa, Va, VIa metals atom } \%}\right) \times \left(1 - \frac{W \text{ atom } \%}{\text{Group IVa, Va, VIa metals atom } \%}\right),$$

the suitable range of B is also $0.005 \leqq B \leqq 0.05$. The optimum range of B is $0.01 \leqq B \leqq 0.04$.

As the binder metal, there is preferably used an iron group metal in a proportion of 3 to 50% by weight based on the gross composition, since if less than 3% by weight, the alloy is brittle and if more than 50% by weight, the alloy is too soft.

For the preparation of starting materials, the reaction is carried out at a high temperature in a hydrogen atmosphere in the case of carburization of a (Mo, W) powder with carbon, reduction and carburization of oxide powders with carbon or combination thereof. At this time, it is found as a result of our studies on the decomposition nitrogen pressure of (Mo, W)(C, N) that the external nitrogen pressure, depending on the temperature, should be 300 Torr or more at 700° C. or higher at which the carbonitrization reaction takes place. The coexistence of hydrogen is not always harmful, but it is desirable to adjust the quantity of hydrogen to at most two times as much as that of nitrogen, in particular, at most the same as that of nitrogen not so as to hinder the nitriding reaction. In the case of using an ammonia decomposition gas, it is necessary to enrich with nitrogen.

For the preparation of starting materials containing oxygen, the coexistence of carbon monoxide and carbon dioxide is required in an atmosphere. In this case, the quantity of hydrogen is not limited as described above, but should not exceed 50% of the atmosphere. Heating and sintering in an atmosphere of nitrogen or carbon oxide is effective for the purpose of preventing an alloy sintered from denitrification or deoxidation.

In the above described five embodiments, the dispersing treatment of an $M_2C$ type phase can be omitted and in this case, considerably excellent effects can also be given.

In cemented carbide alloys consisting predominantly of WC, excellent properties as alloy uses such as drills, hubs, taps, etc. can be obtained by reducing the particle size of the carbide when containing a binder metal in a proportion of up to 15% by weight, but, when the alloy contains a binder metal in a higher proportion, this procedure has no effect. In alloys for low speed cutting, for example, drills, in particular, the edge portion is deformed by friction heat.

Figure 4:
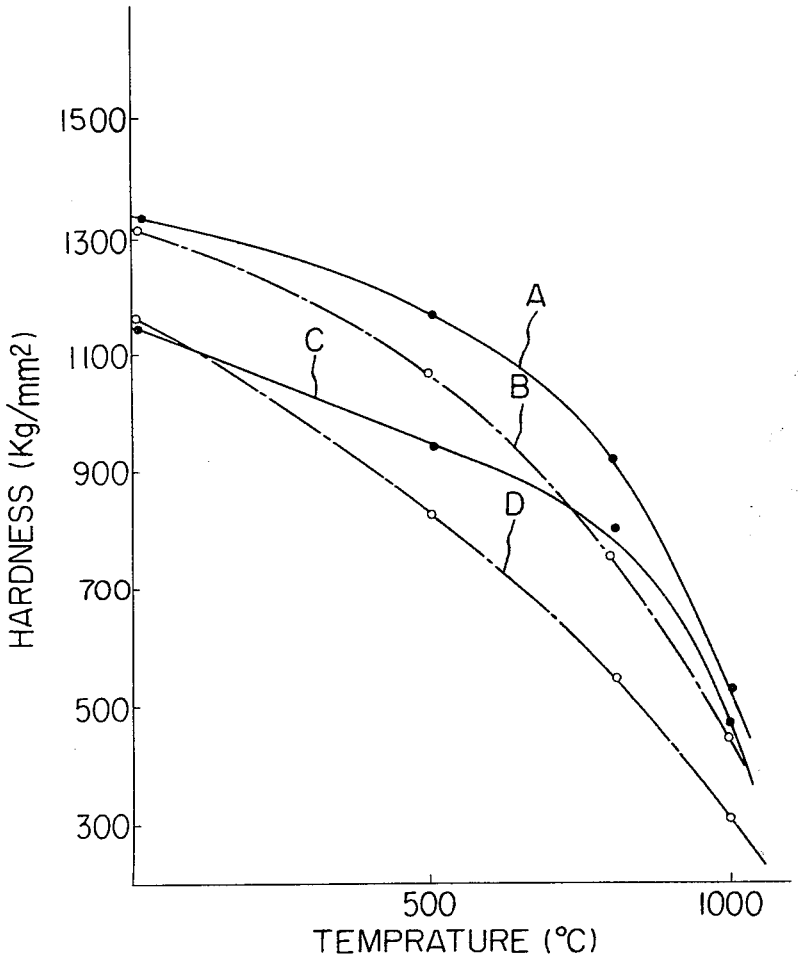
FIG. 4 is a graph comparing the high temperature hardness of a WC-Co alloy according to the prior art and a (Mo, W, Cr)C-Co alloy according to the present invention, in which A shows WC-10% Co, B shows (Mo, W, Cr)-(9% Co+5% Ni), C shows WC-15% Co and D shows (Mo, W, Cr)-15% Co.

The inventors have further made studies to develop an alloy having a higher wear resistance and toughness and consequently, have found that the deformation at a high temperature can remarkably be improved by changing tungsten carbide to a carbide composed of a solid solution of three elements, molybdenum, tungsten and chromium. That is to say, a (Mo, W)C-Co alloy has a higher hardness at a high temperature than a WC-Co alloy and, when Cr is further dissolved in this carbide, the hardness is further raised and the high temperature hardness is also improved. Thus, the disadvantages of the prior art WC-Co alloy can be overcome by one effort (Cf. FIG. 4). It is to be noted that the carbide phase consists of a solid solution of (Mo, W, Cr)C. It is also found that when Cr is dissolved in a solid solution of (Mo, W)C, the carbide particles can be made finer and stabilized as a monocarbide of (Mo, W, Cr)C. On the contrary, the known method of adding merely chromium to the binder phase has the disadvantages that it is impossible to make the carbide finer and the carbide phase is not stabilized as a monocarbide of a solid solution of (Mo, W, Cr). The quantity of chromium to be added to the solid solution carbide (Mo, W)C ranges preferably 0.3 to 10%, since if less than 0.3%, the carbide cannot be made finer, while if more than 10%, $Cr_3C_2$ is separated and precipitated in the alloy, resulting in lowering of the hardness.

In a further embodiment of the present invention, a part of the carbon in the solid solution carbide (Mo, W, Cr)C is replaced by nitrogen, oxygen and/or hydrogen. That is, it is assumed that if the carbon contained in (Mo, W, Cr)C is added as solid and reacted with a reactivity of 100%, the crystal is stabilized, but now it is found that incorporation of not only carbon but also nitrogen results in stabilization of the monocarbide as (Mo, W, Cr) (CN) and further incorporation of oxygen and hydrogen stabilizes more the monocarbide as (Mo, W, Cr)$(C_aN_bO_cH_d)$ $(a+b+c+d=1)$, because if there are defects in the carbide, the carbide is unstable during sintering and an $M_2C$ type mixed carbide precipitates needle-wise to thus lower the strength.

When the quantity of chromium contained in (Mo, W, Cr)C is limited to 0.3 to 10% by weight to thus obtain a finer carbide and one or more of iron group metals such as iron, nickel and cobalt are added as a binder phase in a proportion of 15 to 30% by weight, the so obtained alloy can be used as a cemented carbide alloy for low speed cutting, for example, drills, taps and hubs with an excellent performance. When the binder metal is within a range of 3 to 15% by weight, the alloy can also be used effectively as a corrosion resisting alloy. Useful examples of the corrosion resisting alloy are corrosion resisting seal rings, watch frames, ends of slide calipers, mechanical seals, etc.

Figure 5:
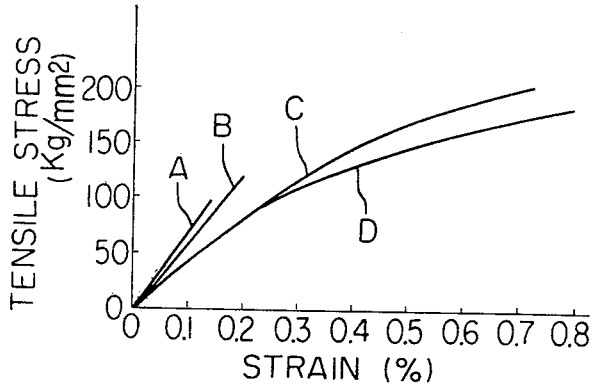
FIG. 5 is a graphical representation of the compressive stress and tensile stress of a WC-Co type alloy as a function of the strain, in which A=WC-5%Co, B=WC-10%Co, C=WC-25%Co, D=WC-30%Co, E=WC-7%Co, F=WC-12%Co and G=WC-15%Co. The percent of Co is by weight.
Figure 5:
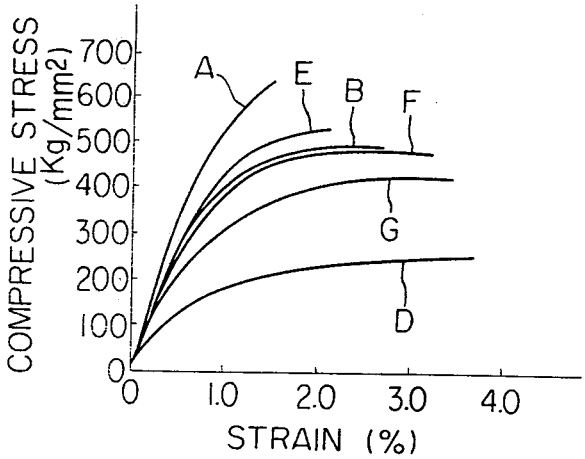

As a material for a cemented carbide alloy there is chosen an alloy having a relatively large cobalt content, which deformation strength is high. As shown in FIG. 5, breakage by deformation does not readily occur with the increase of the quantity of cobalt. If the quantity of cobalt is increased, however, the alloy shows a decreased yielding stress and tends to be deformed. This tendency of deformation is a disadvantage in the case of using the alloy as a forging tool such as headers, although it is hardly cracked.

In accordance with the present invention, there is provided an alloy having a high deformation resistance as well as a sufficient elastic strength without lowering the hardness and it is expected that the properties are more improved than those of the prior art WC-Co type alloys. That is to say, as a result of our detailed studies on WC-Co type alloys, it is found that, in the WC-Co type alloys, an alloy in WC-$\gamma$ zone between the free carbon precipitating zone and $\delta$-phase ($\eta$-$Co_3W_2C$ phase) precipitating zone is excellent in mechanical properties and thus alloy in WC-$\gamma$ zone have mainly been used. This $\gamma$-phase is a phase such that tungsten is dissolved in cobalt and, as well known, the alloy property is changed with the change of the quantity of this solid solution. The deformation strength depends on the quantity of tungsten dissolved in the binder phase cobalt. If none is dissolved in the cobalt, the deformation resistance of the alloy is considered to be increased further, but this is unreasonable unless free carbon is precipitated.

The inventors have made efforts to find an alloy in which the binder phase is held as pure as possible without the coexistence of free carbon. That is to say, one aspect of the present invention consists in that the deformation strength of the binder phase can be held high without substantial dissolving of tungsten and molybdenum in the binder phase even if the quantity of carbon is changed and, in addition, an $M_2C$ type compound occurring due to the lack of carbon is evenly dispersed to prevent stress concentration. In general, alloys comprising carbides of molybdenum and tungsten have not been put to practical use because of precipitation of a needle carbide $(Mo, W)_2C$ which causes a marked decrease of the alloy strength. The inventors, however, have succeeded in increasing the deformation resistance of the alloy without deterioration of the strength thereof by dispersing well $(Mo, W)_2C$.

Figure 6:
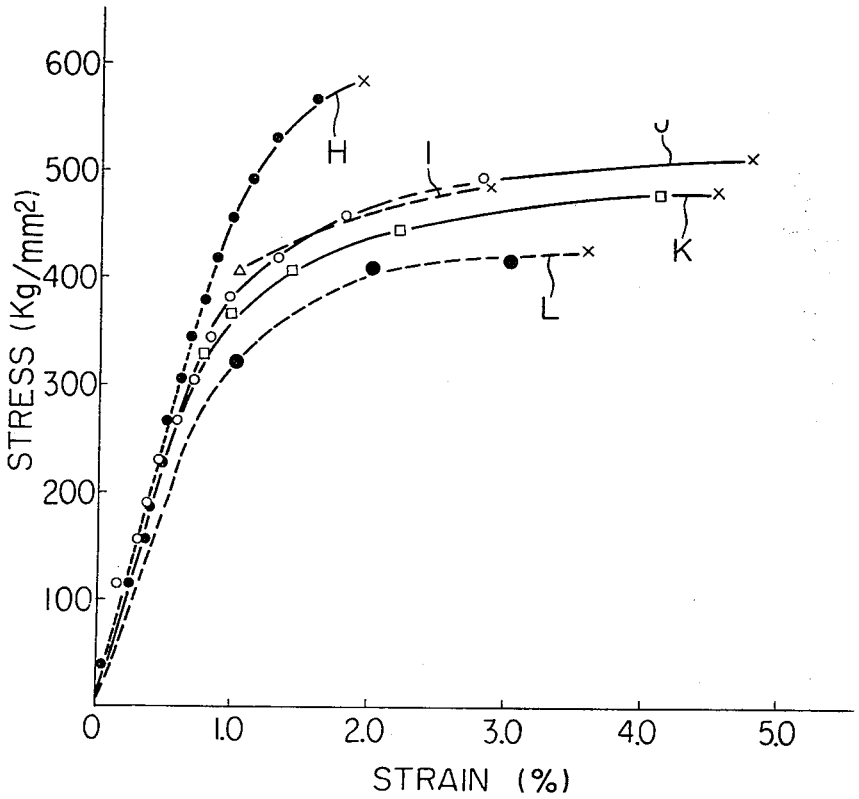
FIG. 6 is a graph comparing the compressive stress as a function of the strain of a (Mo, W)C-Co alloy according to the present invention and a WC-Co alloy of the prior art, in which H=WC-11%Co, I=WC-16%Co, J=$(Mo_{0.7}W_{0.3})$C-11%Co, K=$(Mo_{0.5}W_{0.5})$C-19%Co and L=WC-24%Co. The quantity of the binder metals Co and Ni is by volume percent.

FIG. 6 is a graph comparing the compressive stress as a function of the strain of a (Mo, W)C-Co alloy according to the present invention and a WC-Co alloy of the prior art. It is found that the prior art WC-Co type alloy shows a strain of about 2 to 4% at compression, whilst the alloy of the present invention shows a strain of 4 to 5%. For example, a WC-24% by volume Co alloy shows a yielding stress of 400 $Kg/mm^2$ and a deformation of about 4%, while, on the contrary, the alloy of the present invention exhibits a higher yielding stress, i.e. 500 $Kg/mm^2$ and a deformation amounting to about 5%.

In the alloy of the present invention, in which the composition ratio of molybdenum and tungsten is represented by $(Mo_xW_y)C$, the composition of $(Mo_xW_y)C$ in the alloy is not always limited to one, but two or more combinations can be used to change the alloy property. In this case, a carbide of $M_2C$ type, i.e. $(Mo, W)_2C$ should be uniformly dispersed to give a desired effect. The advantages of the present invention can be realized even when the alloy contains carbides, nitrides and carbonitrides of Group IVa, Va and VIa metals. Furthermore, replacement of C in (Mo, W)C or $(Mo, W)_2C$ by N, O and/or H can be carried out with retention of the advantages of the present invention. These alloys having, in particular, an excellent shock resisting toughness and can favorably be used as can-making tools, dies, mining tools, rolls, etc. in addition to headers well-known as a shock resisting tool.

In a still further embodiment of the present invention, one or more of manganese, rhenium, copper, silver, zinc and gold are incorporated in the binder phase to change the microstructure of the binder phase and to make non-magnetic. At the same time, it is found that, when these elements are added, the binder phase is alloyed, whereby the corrosion resistance of the alloy is improved. The hardness and wear resistance of the alloy are deteriorated if the quantity of the binder phase exceeds 30% by weight and the wear resistance of the alloy is not lowered unless the quantity of these elements exceeds 5% by weight.

In the case of WC type alloys, it is desirable, as is well known, to design the alloy in a low carbon alloy so as to improve markedly the non-magnetization and corrosion resistance thereof and if the quantity of the alloyed carbon is less than WC-$\gamma$ phase zone, tungsten is dissolved in the binder phase in a large amount to lower readily the magnetism. In the case of (Mo, W)C type alloys, on the other hand, the magnetism is lowered with difficulty even if it is desired in a low carbon alloy. When using nickel as the binder metal, however, there is obtained a remarkable effect in combination with the above described additives. In a low carbon alloy, an $M_2C$ phase is precipitated and preferentially corroded because it is relatively basic electrochemically as compared with a (Mo, W)C phase. It is found, however, that when an $M_2C$ phase is evenly dispersed in a proportion of 30% by volume or less in the alloy, the alloy base is not corroded and the corrosion resistance as the whole alloy body is rather improved because the $M_2C$ phase is in a fine globular form. That is, a low carbon alloy in which an $M_2C$ phase is uniformly dispersed in a proportion of at most 30% by volume is desired which is made corrosion resistant and non-magnetic by using nickel as a binder phase and adding at least one of manganese, rhenium, copper, silver, zinc and gold thereto.

In the production of the alloy of the present invention, the alloy is unavoidably contaminated with small amounts of impurities such as iron, cobalt, etc., but as far as the sum of these impurities does not exceed 1%, the advantages of the present invention can well be kept.

In a still further embodiment of the present invention, the quantity of iron in the alloy is preferably controlled by the relation of:

$$0.001 \leqq \frac{\text{Amount of Iron (wt \%)}}{\text{Amount of Binder Metals (wt \%)}} \leqq 0.1$$

In this case, the hard phase consists of (Mo, W)C, and the binder phase consists of Co and Ni, to which Fe is added as additive element. Thus, a carbide of $(Mo, W)_2C$ type is precipitated in a granular form, not in a needle-like form. The quantity of Fe to be added as the additive element is preferably 0.1 to 10% by weight, since if less than 0.1%, the effect of Fe is little, and if more than 10%, the precipitate of $M_2C$ type is too coarse to hold the alloy strength. For the addition of Fe, it can be added to the alloy or the reaction mixture during production of the carbide. The carburization reactivity of the carbide can be controlled by changing the quantity of Fe. If the quantity of Fe is less than 0.1%, the carburization does not proceed sufficiently and, when using the thus resulting carbide for the production of an alloy, the carbide of $M_2C$ type is hardly dispersed in a granular form in the alloy, while if more than 10%, the carbide is alloyed and grinding thereof is very difficult resulting in lowering of the yield of the carbide useful for the production of a hard alloy. A (Mo, W)C alloy in which an $M_2C$ type carbide is precipitated and dispersed according to the feature of the present invention has a high alloy strength as a so-called dispersion type alloy. When the particle size distribution and dispersed state of the $M_2C$ type carbide are not uniform or differ in the interior and exterior portion of the alloy, however, the alloy strength cannot be kept very high. In the case of large-sized alloys or alloys having a large content of a binder phase, for example, Morgan Rolls, super-high pressure pistons, anvils and the like, there is often the following problem. That is to say, where carbon is diffused from outside the alloy resulting in a marked difference of carbon contents between the exterior and interior portions of the alloy, or where the cooling speed differs in the surface portion and interior portion of the alloy, the precipitation conditions of molybdenum and tungsten from the liquid phase are not the same and the shapes and dispersed states of the $M_2C$ type carbide are different in the exterior and interior portions of the alloy. In the exterior or surface portion of the alloy, the $M_2C$ tends to be coarsened and agglomerated, thus resulting in lowering of the strength.

According to the embodiment of the present invention, this problem can be solved. When using cobalt and nickel as the binder phase and adding iron in a proportion of 0.1 to 10%, the carbide of $M_2C$ type is stably precipitated and dispersed independently on the quantity of the binder phase and the shape of the alloy to thus keep a high alloy strength. If the binder phase is of cobalt only, $M_2C$ tends to be agglomerated and if it is of nickel only, the hardness and compressive strength of the alloy are lowered. When the quantity of iron in the binder phase is less than 0.1%, there is not such a large effect thereof, while if more than 10%, the corrosion resistance and strength of the alloy are deteriorated.

In this embodiment also, it is desired that a binder phase comprising an iron group metal as a predominant component is in a proportion of 3 to 50% by weight of the gross composition, since if less than 3% by weight, the alloy is too brittle, while if more than 50% by weight, the high temperature property is deteriorated. It is also natural that the iron group metal as the binder phase dissolves Group IVa, Va and VIa metals and, moreover, the merits or effects of the present invention will not be lost even by the addition of elements having a solubility therein such as aluminum, silicon, calcium, silver, etc. The basic concept of the present invention can be realized even when a part of the molybdenum and tungsten carbide is replaced by a B1 type mixed carbide containing titanium, zirconium, hafnium, vanadium, niobium, tantalum, chromium, molybdenum and/or tungsten. Furthermore, the properties of our alloy are not so changed even if a part of Mo and W in (Mo, W)(CNO) or (Mo, W)C is replaced by other elements as far as it holds the simple hexagonal structure.

As is apparent from the aspect of this embodiment, a micro amount of iron is essential as a stabilizer in a (Mo, W)C alloy or (Mo, W)(CNO) alloy. As a method of dispersing iron, it is desirable to add iron during formation of the carbide, and to effect the carburization reaction at a temperature of 1500° C. or higher in a stabilizing atmosphere of nitrogen or carbon oxide.

A process for the production of (Mo, W)C has hitherto been known which comprises adding a large amount of a diffusion aiding agent such as iron or cobalt to $Mo_2C$ and WC and subjecting to reaction at 2000° C. or higher (Japanese Patent Application (OPI) No. 146306/1976). In this process, iron is added for the purpose of promoting the solid solution forming reaction of WC and $Mo_2C$.

In the embodiment of the present invention, a small amount of iron can be added when a complete Mo-W solid solution, (Mo, W) alloy powder is carburized, or when a (Mo, W) oxide is directly carburized. The iron added is used for the stabilizing reaction at a temperature of 1500° C. or higher and has no bad influence upon the carbide.

In this embodiment, a part of the carbon in the carbide can also be replaced by nitrogen and/or oxygen with holding substantially the similar effects.

In the last embodiment of the present invention, the toughness of the alloy can be raised by using, in combination, two or more carbides having a simple hexagonal phase but differing in the ratio of Mo/W. The detailed reason for increasing the toughness is not clear, but it is assumed that when (Mo, W)C is separated into two phases, the solution strain of both the phases is lowered to give a higher toughness than in the case of a single phase. Since at least an alloy consisting of a $(Mo_xW_y)C$ $(y>x)$ phase having the similar property to that of WC and a $(Mo_xW_y)C$ $(x>y)$ phase having the similar property to that of MoC has two properties, i.e. toughness of WC and heat and deformation resistance of MoC, this embodiment is advantageous more than when using one kind of (Mo, W)C only. Most preferably, the carbide is composed of WC or a solid solution of some MoC dissolved in WC and a solid solution of WC dissolved in MoC. This corresponds to a case where the peak of plane (1, 0, 3) is separated in two in X-ray diffraction. Whether there are two or more simple hexagonal phases of $(Mo_xW_y)C$ or not can be confirmed by observation using an optical microscope after etching with an alkaline solution of a hexacyanoferrate (III) or by XMA observation.

The application or use range of the alloy of the present invention is as follows. For example, the alloy of the present invention can be used for wear resisting tools such as guide rollers, hot wire milling rollers, etc., and for cutting tools, because of having a toughness and hardness similar to or more than those of WC-Co alloys. In particular, when the alloy of the invention as a substrate is coated with one or more wear resisting ceramic layers such for example as of TiC, TiN, $Al_2O_3$, cutting tools more excellent in toughness as well as wear resistance can be obtained than the prior art tools having WC-Co type alloys as a substrate. As well known in the art, at this time, a decarburization layer called $\eta$-phase is formed at the boundary between the substrate and coating layer and this appears similarly in the alloy of the present invention. In order to prevent the embrittlement directly under the coating layer due to decarburization, the presence of free carbon (FC) in the surface layer within a range of 300 microns is effective without deteriorating the toughness.

When using the alloy of the present invention as a watch case, it shows more excellent properties as a watch case than WC-Co type alloys, which are summarized below:

(1) Beautiful brightness can be given when the alloy is specularly finished.

(2) Grinding and polishing workings are possible.

(3) Corrosion resistance is excellent, in particular, for sweat in the case of trinkets.

(4) Mechanical strength is considerably high.

According to the present invention, the deformation resistance of an alloy can be increased without deteriorating the strength thereof by dispersing well or evenly $(Mo, W)_2C$. A carbide of $M_2C$ type itself has a low hardness (Vickers hardness of $Mo_2C$: 1500 Kg/mm$^2$), but, when this $M_2C$ is dispersed uniformly in an alloy, the alloy can hold a high toughness without lowering as a whole the hardness thereof because the soft $M_2C$ can moderate an impulsive force added to the alloy. Because of the high wear resistance and high toughness with the low price, the allow of the present invention is suitable for spikes for shoes or ice spikes. When a carbide of $M_2C$ is suitably or uniformly dispersed in an alloy, the alloy shows a good sliding property on a concrete surface and can absorb shock from the roughness of a concrete surface.

The present invention will be further illustrated in greater detail in the following examples. It will be self-evident to those skilled in the art that the ratios, ingredients in the following formulation and the order of operations can be modified within the scope of the present invention. Therefore, the present invention is not to be interpreted as being limited to the following examples. All parts, percents and the like are to be taken as those by weight unless otherwise indicated.

EXAMPLE 1

$(Mo_{0.7}W_{0.3})C$ containing 0.2% of Fe as an additive was used as a starting material. Starting materials were taken by weighing so that the gross composition be $(Mo_{0.7}W_{0.3})C_z$-15% Co and z in this formula (carbon content in alloy/theoretical carbon content) be 100, 98 and 96 atomic %, mixed by wet process in an organic solvent, dried, compacted and sintered at 1450° C. in vacuum. For comparison, the similar procedure was repeated except using a Fe-free starting material. The properties of the resulting alloys are shown in Table 1:

TABLE 1

| | | T.R.S. (kg/mm$^2$) | Hardness (HRA) | T.C. (%) | F.C. (%) | z (%) |
|---|---|---|---|---|---|---|
| Fe-containing Sample | (A) | 190 | 86.8 | 7.61 | 0.02 | 100 |
| | (B) | 290 | 87.1 | 7.43 | 0.00 | 98 |
| | (C) | 260 | 87.2 | 7.28 | 0.00 | 96 |
| Fe-free Sample | (D) | 175 | 86.8 | 7.59 | 0.00 | 100 |
| | (E) | 140 | 87.0 | 7.43 | 0.00 | 98 |
| | (F) | 120 | 87.1 | 7.28 | 0.00 | 96 |

Note:
T.R.S. = Transverse Rupture Strength
T.C. = Total Carbon
F.C. = Free Carbon As can be seen from these results, the alloys of the present invention (B) and (C) are more excellent in toughness than the alloys of the prior art (A), (D), (E) and (F). In the alloys of the present invention, the alloy strength is not lowered even if the carbon content is less than the theoretical carbon content, while in the prior art alloys, a molybdenum-tungsten mixed carbide of $M_2C$ type due to lack of carbon is precipitated as a needle crystal, resulting in lowering of the toughness of the alloy.

FIG. 1 is a micrograph of the prior art alloy (E) and FIG. 2 is a micrograph of our alloy (B).

EXAMPLE 2

A powdered solid solution of $(Mo_{0.9}W_{0.1})$ with a particle size of 6 microns was mixed with 0.2% of Fe powder and variable amounts of carbon to give a z value as shown in Table 2, subjected to carburization at 1600° C. for 1 hour in nitrogen gas and pulverized. The carbide was heated for 30 minutes in CO gas and stabilized. The resulting carbide was a carbide in which MC and $M_2C$ phases were coexistent as shown in Table 2. The carbide was mixed with 10% of Co and 10% of Ni and sintered at 1300° C. The properties of the so obtained alloys are shown in Table 2:

TABLE 2

| $(Mo_{0.9}W_{0.1})C_z$ | Carbide | | | | Properties of Alloys | |
|---|---|---|---|---|---|---|
| z | T.C. % | $O_2$% | $N_2$% | $M_2C$ vol % | T.R.S. | Charpy Impact Value (Kg . mm) |
| 1.0 | 10.29 | 0.3 | 0.2 | 0 | 180 | 0.4 |
| 0.95 | 9.74 | 0.2 | 0.05 | 7 | 260 | 0.7 |
| 0.9 | 9.22 | 0.2 | 0.05 | 14 | 280 | 0.8 |
| 0.8 | 8.23 | 0.2 | 0.03 | 30 | 220 | 0.7 |
| 0.7 | 7.20 | 0.1 | 0.02 | 45 | 170 | 0.3 |
| 0.6 | 6.17 | 0.1 | 0.01 | 55 | 140 | 0.2 |
| 0.5 | 5.14 | 0.1 | 0.01 | 75 | 100 | 0.1 |

As can be seen from this table, the practical alloy strength cannot be obtained in cases where the value of z in $(Mo, W)C_z$ is 1.0 or less than 0.7.

EXAMPLE 3

80 to 90% of a carbide having the theoretical combined carbon content $(Mo_{0.7}W_{0.3})C$ with a particle size of 5 microns, 0 to 10% of $(Mo_{0.7}W_{0.3})_2C$ with a particle size of 3 microns, 9 to 10% of Co and 0.1 to 0.5% of Fe, Re, Si, B and Be were mixed and alloys were prepared in an analogous manner to Example 1. In the texture of the alloy obtained in this way, there was evenly dispersed a carbide of $M_2C$ type $(Mo, W)_2C$ as shown in FIG. 2, while in the prior art alloy of (Mo, W)C-$(Mo, W)_2C$-Co, needle crystals were precipitated as shown in FIG. 1. For comparison, the properties of these alloys are shown in Table 3:

TABLE 3

| Run No. | $(Mo_{0.7}W_{0.3})C$ (%) | $(Mo_{0.7}W_{0.3})_2C$ (%) | Co (%) | Dispersing Agent (%) | T.R.S. ($Kg/mm^2$) |
|---|---|---|---|---|---|
| 1 | 85 | 5 | 9.9 | Fe 0.1 | 260 |
| 2 | 82 | 8 | 9.5 | Re 0.5 | 190 |
| 3 | 88 | 2 | 9.8 | Si 0.2 | 240 |
| 4 | 88 | 1 | 9.9 | B 0.1 | 270 |
| 5 | 87 | 3 | 9.7 | Be 0.3 | 200 |
| 6 | 87 | 3 | 10 | — | 150 |
| 7 | 82 | 8 | 10 | — | 120 |
| 8 | 89 | 1 | 10 | — | 160 |

Note:
Run Nos. 1–5: Present Invention;
Run Nos. 6–8: Prior Art

As evident from this table, the alloys of the present invention, in which $(Mo, W)_2C$ is dispersed by the addition of an impurity, exhibit a high toughness.

EXAMPLE 4

86% of $(Mo_{0.7}W_{0.3})C$ powder with a particle size of 5 microns, 5% of $(Mo_{0.7}W_{0.3})_2C$ powder with a particle size of 2 microns, 9% of Co powder and 0.2% of Fe powder were weighed, mixed by wet process in an organic solvent, dried, compacted and sintered at 1450° C. in vacuum, thus obtaining an alloy having a transverse rupture strength of 260 $Kg/mm^2$ and a hardness (Hv) of 1400 $Kg/mm^2$. Then, this alloy was subjected to a carburizing treatment to precipitate free carbon within a range of 300 microns from the surface layer and coated with a layer of Tic, double layer of TiC and TiN or double layer of TiC and $Al_2O_3$. For comparison, a commericaly sold WC type alloy was similarly coated. The so obtained inserts Sample Nos. 1–6 were subjected to a cutting test under the following conditions (Form No. SNU 432):

| | |
|---|---|
| Workpiece | SCM 3 ($H_B$ = 280) |
| Cutting Speed | v = 170 m/min |
| Feed | f = 0.86 mm/rev |
| Depth of Cut | d = 1.5 mm |
| Cutting Time | 30 min |

Test results are shown in Table 4:

TABLE 4

| Sample No. | Coating Layer | $V_B$ (mm) | $K_T$ (mm) |
|---|---|---|---|
| Our Invention | | | |
| No. 1 | TiC | 0.16 | 0.09 |
| No. 2 | TiC, TiN | 0.14 | 0.03 |
| No. 3 | TiC, $Al_2O_3$ | 0.12 | 0.02 |
| WC-type Alloy | | | |
| No. 4 | TiC | 0.21 | 0.10 |
| No. 5 | TiC, TiN | 0.17 | 0.04 |
| No. 6 | TiC, $Al_2O_3$ | 0.15 | 0.03 |

As evident from these results, the alloy of the present invention is similar to or superior to the prior art WC-type alloy as to $V_B$ (Flank Wear) and $K_T$ (Depth of Crater). There was found no decarburization layer ($\eta$-phase) in the interface between the substrate of our alloy and the TiC layer and F.C. (free carbon) was found within a range of 300 microns directly under the coating layer.

EXAMPLE 5

$Mo_2C$ powder with a particle size of 2 microns, WC powder with a particle size of 2 microns and carbon powder with Co powder as a diffusion aid were mixed so as to give a final gross composition of $(Mo_{0.8}W_{0.2})(C_{0.95}N_{0.05})_{1.0}$ and then reacted at 1800° C. for 30 minutes in a nitrogen-hydrogen stream having a nitrogen partial pressure of 0.5 atm. X-ray diffraction showed formation of a simple hexagonal crystal of WC type.

This powder was mixed with Co powder to give a final alloy composition of $(Mo_{0.8}W_{0.2})(C, N)$-10% Co, compacted to form a desired shape and then sintered. The sintering was carried out by heating in a vacuum of $10^{-2}$ Torr up to 1000° C. and in Co atmosphere under a reduced pressure of 10 Torr from 1000° C. to 1400° C. On the other hand, for comparison, an alloy was prepared in a similar manner but using no nitrogen in the step of producing the carbide and no carbon monoxide in the step of sintering. The results are shown in Table 5:

TABLE 5

| Composition of Hard Phase | A-Value | B-Value | Texture |
|---|---|---|---|
| Our Invention $(Mo_{0.8}W_{0.2})(C_{0.93}N_{0.04}O_{0.01})_{0.98}$ | 0.04 | 0.01 | WC type phase + Co phase |
| Prior Art $(M_{0.8}W_{0.2})(C_{0.976}N_{0.004})_{0.98}$ | 0.004 | 0.00 | WC type phase + needle $M_2C$ type phase + free carbon + Co phase |

The alloy of the present invention is light and excellent in shock resistance as well as high temperature hardness according to test results. Therefore, the alloy of our invention is suitable for various tools, in particular, wear resisting tools.

EXAMPLE 6

A previously prepared solid solution powder of $(Mo_{0.7}W_{0.15}Cr_{0.15})$ with a particle size of 2 microns was mixed with carbon and 0.2% of Fe as a diffusion aiding agent, carburized at 1800° C. in hydrogen and then reacted at 1300° C. for 30 minutes in a mixed gas of nitrogen and carbon monoxide. The hard phase thus obtained, having a gross composition of $(Mo_{0.7}W_{0.15}Cr_{0.15})(C_{0.90}N_{0.06}O_{0.01})$, was mixed with 9.5% of a binder metal consisting of Co/Ni (1/1) containing a micro amount of Fe and sintered. X-ray diffraction showed that the resulting alloy was composed of a hexagonal monocarbide of (Mo, W, Cr)C and a $(Mo, W, Cr)_2C$ phase with the binder phase. In view of the structure, a granular carbide of $M_2C$ type was evenly dispersed in the alloy.

This alloy has a better corrosion resistance, in particular, for sweat as compared with the prior art WC-Co type alloys and, in addition, it is suitable for use as trinkets such as watch case because of its light weight and as non-magentic alloys.

EXAMPLE 7

60% of $(Mo_{0.7}W_{0.3})(C_{0.9}N_{0.08})$ prepared by mixing (Mo, W)$O_3$ with carbon and 0.05% of Fe and reacting at 1700° C. in nitrogen at 1.1 atm, 30% of $(Ti_{0.7}W_{0.3})(C_{0.85}N_{0.15})$, 5% of Co and 5% of Ni was mixed and ball milled by wet process. The thus mixed powder was compacted, then heated in vacuum up to 800° C., in $H_2$ of 30 Torr up to 1200° C. and in CO of 30 Torr at 1200° to 1400° C. and held at 1400° C. for 1 hour to finish the sintering.

Analysis of the alloy showed: A=0.11 and B=0.02 and examination of the structure showed that there were a (Mo, W)(CN) phase and a (Mo, W)$_2$C phase dispersed well in a globular form.

For comparison, a nitrogen-free alloy was prepared by sintering in vacuum only.

These samples were subjected to a cutting test under the following conditions:

| | |
|---|---|
| Workpiece | Ordinary Steel (Hardness: RC 20–29) |
| Cutting Speed | 150 m/min |
| Feed | 0.381 mm/rev |
| Depth of Cut | 0.13 mm |

The results are shown in Table 6:

TABLE 6

| | Cutting Time (min) | Flank Wear (mm) | Crater Wear (mm) | Edge Deformation (mm) |
|---|---|---|---|---|
| Alloy of Our Invention | 15 | 0.15 | 0.010 | 0.006 |
| Alloy of Prior Art | 15 | 0.20 | 0.017 | 0.015 |

As can be seen from these results, our alloy is more excellent in wear resistance as well as edge deformation resistance than the prior art alloy. When the alloy of the present invention was coated with one or more of carbides, nitrides, oxides and borides in monolayer or multilayer to form a so-called coated insert, the excellent edge deformation resistance of the alloy could be well realized.

EXAMPLE 8

$MoO_3$ powder and $WO_3$ powder were weighed to give a calculated quantity of Mo/W ratio of 8/2, and mixed with carbon in a proportion sufficient to remove the oxygen in the oxides and 0.2% of Fe as a catalyst for fixing nitrogen during the reaction. The mixture was reacted at 1500° C. for 1 hour in a gaseous stream of ($NH_3$+10 vol % CO) to complete the reducing reaction.

X-ray analysis of the resulting compound showed the formation of a hexagonal type compound of (Mo, W)(CNO).

This carbide was mixed with 10% of Co and Ni and an alloy was prepared therefrom in an analogous manner to Example 5. Analysis of the resulting alloy showed A=0.2 and B=0.03 and examination of the structure thereof showed that a granular carbide of $M_2C$ type was evenly dispersed in a proportion of 2% by volume. This alloy was particularly excellent in shock resistance.

EXAMPLE 9

527 g of WC powder with a particle size of 1 micron, 430 g of $Mo_2C$ powder with a particle size of 2 microns and 13 g of $Cr_3O_2$ were mixed, to which 5 g of Co powder as a diffusion aid and 27 g of carbon black for filling up the lack of carbon were further added, and ball milled by dry process for about 30 hours. The thus mixed powder was reacted at 2000° C. in a $H_2$ stream to form a primary carbide. The primary carbide was well ground and then subjected to secondary carburization. In the secondary carburization, the carbide was further reacted under each of the following conditions, whereby a part of the carbon in the carbide (Mo, W, Cr)C was replaced by oxygen, nitrogen and hydrogen and the carbide was more stabilized:

(I) in $NH_3$ stream, 1400° C.×1 hour
(II) in CO stream, 1600° C.×2 hours
(III) in $H_2$ stream, 1500° C.×1 hour
(IV) in vacuum, 1500° C.×1 hour Various carbides were obtained as shown in Table 7:

TABLE 7

| Method | T.C. (%) | F.C. (%) | $O_2$ (%) | $N_2$ (%) | $H_2$ (%) | Co (%) |
|---|---|---|---|---|---|---|
| I) | 8.33 | 0.08 | 0.03 | 0.25 | 0.01 | 0.5 |
| II) | 8.32 | 0.05 | 0.21 | 0.05 | 0.001 | 0.5 |
| III) | 8.45 | 0.03 | 0.003 | 0.01 | 0.02 | 0.5 |
| IV) | 8.53 | 0.30 | 0.001 | 0.001 | 0.001 | 0.5 |

The carbides prepared by heating in gaseous atmospheres were all of a monocarbide, while the carbide obtained by heating in vacuum contained free carbon in a large amount of $Mo_2C$ precipitated according to the results of X-ray analysis.

When a (Mo, W, Cr)C-16% (Co+Ni) alloy was then prepared using Carbide II) of the above described carbides, there was found an $M_2C$ phase dispersed evenly in the alloy in a proportion of 10% by volume.

The properties of our alloy and the prior art WC-Co alloy were compared using an end mill under the following conditions:

| | |
|---|---|
| Workpiece: | SCM 3, HRC 8–13, Length 385 mm, |
| End Mill: | 8 mm $\phi$, Two Cutting Edges, Right Cutting Edge Right Twist 25°, Solid |
| Cutting System: | Cutting of Groove in 5 mm Depth on Above Workpiece, Comparison of Lifes by Measurement of Time or Cutting Length until $V_B$ = 0.3 mm or until chipping |
| Machine: | No. 4 Plain Milling Machine |
| Cutting Conditions: | V = 26.5 m/min f = 0.0285 mm/edge Water-insoluble Cutting Oil |

The results are shown in Table 8:

TABLE 8

| | Cutting Length | Number of Grooves Cut |
|---|---|---|
| Alloy of Present Invention | 36.3 m | 92.6 |
| Fine Particle WC Alloy of Prior Art | 24.5 | 62.5 |
| Cemented Carbide Alloy K10 of Prior Art | 1.54 | 4 |

TABLE 8-continued

| | Cutting Length | Number of Grooves Cut |
|---|---|---|
| High Speed Steel | 2.55 | 67 |

As evident from these results, the alloy of the present invention is superior to other known alloys concerning the wear resistance and chipping resistance, since in our alloy, the high temperature hardness is high and, thus, the toughness can be raised without lowering the wear resistance even if the quantity of the binder phase is increased.

EXAMPLE 10

The solid solution carbide (Mo, W, Cr)C obtained by the procedure set forth in Example 9 was mixed with 10% of Ni powder and ball milled sufficiently for 100 hours by wet process in an organic solvent. The thus mixed powder was compacted under a pressure of 1 tons/cm$^2$ and alloyed at a temperature of 1400° C. In the resulting alloy, there was found a (MO, W)$_2$C phase with 1 micron or less dispersed evenly in a proportion of 5% by volume.

The resulting alloy was subjected to rubbing using a diamond paste to give a specular surface. The physical properties of this alloy are shown in Table 9, from which it is apparent that the alloy of the present invention is superior to the prior art WC-Co type alloys in density, toughness and corrosion resistance to sweat:

TABLE 9

| | Density | Hardness | T.R.S. (Kg/mm$^2$) | Corrosion* Resistance |
|---|---|---|---|---|
| Alloy of Present Invention | 10.8 | 91.0 | 180 | Good |
| WC-Co Alloy of Prior Art | 14.5 | 90.5 | 160 | Not Good |

Note:
Corrosion Resistance was measured by immersing in an artificial sweat for 48 hours.

When a watch frame was made of this alloy and subjected to a performance test, the alloy of the present invention was more useful because of its light weight and excellent resistance to scratching and to sweat.

EXAMPLE 11

80% of a carbide of molybdenum and tungsten with a molar ratio of 7:3, $(Mo_{0.7}W_{0.3})C$ was mixed with 10% of Co and 10% of Ni, after which the quantity of carbon was controlled so that the carbon content in the alloy be 98 at % based on the carbon content 7.11% in the stoichiometric composition of the alloy.

For a comparative test, Sample Nos. (I) to (III) were prepared as shown in the following:

Sample No. (I): 0.1% of Fe was added as an impurity to the above described alloy so as to disperse (Mo, W)$_2$C evenly according to the present invention.

Sample No. (II): No impurity was added to the above described alloy as in the prior art.

Sample No. (III): Prior art WC-18 vol%Co alloy for impact tools.

In the present invention, (Mo, W)$_2$C was uniformly dispersed in a granular form with proportion of about 8% by volume as shown in FIG. 2, whilst in the prior art (Mo, W)C-Co alloy, needle crystals were precipitated as shown in FIG. 1.

Headers were made of these alloys and the life tests thereof were carried out by subjecting to plastic working of the head of a screw consisting of SCr 4 steel rod, thus obtaining results as shown in Table 10:

TABLE 10

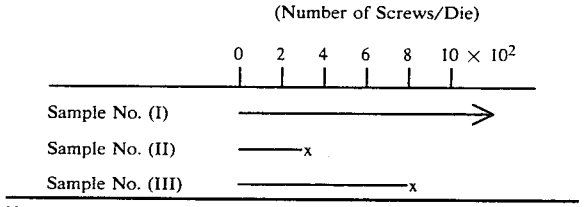

Note:
Mark x means a broken point.

As can be seen from the test result, the alloy of the present invention shows the maximum life and a sufficient performance even if cracks or deformations occur.

EXAMPLE 12

A $(Mo_{0.7}W_{0.3})C_z$ powder where z=0.9 was synthesized, mixed with 15% of Ni powder and 2% of Mn powder, ball milled adequately by wet process, compacted and sintered at 1350° C. in vacuum. Examination of the texture showed the presence of a granular (Mo, W)$_2$C with a size of 2 microns dispersed in a proportion of about 10% by volume.

The properties of the thus obtained alloy are as follows:

Density: 9.88 g/cm$^3$
Hardness: $H_{RA}=88.5$, $H_c=0.4\pi\sigma=o$
Transverse Rupture Strength: 170 Kg/mm$^2$ This cemented carbide alloy is non-magnetic.

EXAMPLE 13

The quantity of carbon is an alloy consisting of 85% of $(Mo_{0.7}W_{0.3})C$, 16% of Ni, 0.6% of Mn and 3% of Re was controlled so that the alloyed carbon content be 95 at % based on the theoretical carbon content (7.59%) and 0.1% of Fe was added to the alloy. The mixture was sintered at 1450° C. for 1 hour in vacuum, thus obtaining an alloy having the following properties:

| | |
|---|---|
| Density: 10.25 g/cm$^3$ | Hardness: $H_{RA}$ 89.4 |
| Transverse Rupture Strength: | 165 Kg/mm$^2$ |
| $4\pi\sigma = 0$ | $H_c = 0$ |

About 1% by volume of an $M_2C$ phase was found in the structure of the present alloy. The corrosion resistance of the alloy of the present invention and that of the prior art WC-7% Co alloy are tabulated below:

TABLE 11

| | (Unit: mg/cm$^2$/hr) Hot 10 % $H_2SO_4$ Solution | Hot 35% $HNO_3$ Solution | Alkali |
|---|---|---|---|
| WC-7% Co Alloy | 15 | 9 | 0 |
| Our Alloy | 0.4 | 4 | 0 |

EXAMPLE 14

Using $(Mo_{0.7}W_{0.3})C$ prepared by adding 0.2% of Fe during production of the carbide, there were obtained for trial Composition (A) $(Mo_{0.7}W_{0.3})C$-15% Co, Composition (B) $(Mo_{0.7}W_{0.3})C$-7.5% Co-7.5% Ni and Composition (C) $(Mo_{0.7}W_{0.3})C$-15% Ni. During the same time, starting materials were taken by weighing so that the alloyed carbon content z in $(Mo_{0.7}W_{0.3})C_z$ be 98 at %, ball milled by wet process in an organic solvent, dried, compacted and then sintered at 1350° C. in vacuum to thus obtain alloys having the properties shown in Table 12.

For comparison, the alloy properties of the prior art compositions, i.e. Composition (D) (Mo, W)C-15% Co and Composition (E) (Mo, W)C-7.5% Co-7.5% Ni are also shown in Table 12. The sum of oxygen and nitrogen in our alloys (A), (B) and (C) was 0.15.

TABLE 12

| | T.R.S. ($Kg/mm^2$) | Hardness (HRA) | T.C. | F.C. | Value z (at %) | Amount of Fe in Binder Phase (%) |
|---|---|---|---|---|---|---|
| Our Invention | | | | | | |
| Composition (A) | 240 | 87.0 | 7.43 | 0.00 | 98 | 1.1 |
| Composition (B) | 290 | 86.9 | " | " | " | " |
| Composition (C) | 230 | 86.5 | " | " | " | " |
| Prior Art | | | | | | |
| Composition (D) | 175 | 86.8 | 7.59 | " | 100 | — |
| Composition (E) | 140 | 86.6 | 7.43 | " | 98 | — |

As is evident from this table, the alloys of the present invention (A), (B) and (C) have a higher toughness than the prior art alloys (D) and (E).

According to the present invention, the alloy is stabilized and, consequently, the alloy strength is not lowered by the presence of Fe, N and O in the alloy even if the alloyed carbon content is less than the theoretical carbon content. In the alloy of the present invention, a granular $(Mo, W)_2C$ was evenly precipitated, while in the prior art alloy, $(Mo, W)_2C$ due to lack of carbon was precipitated as needle crystals, resulting in lowering of the toughness.

EXAMPLE 15

Starting materials were mixed so that the hard phase of a desired alloy be composed of $(Mo_{0.7}W_{0.3})C$ of 5 microns and $(Mo_{0.7}W_{0.3})_2C$ of 3 microns and the binder phase be composed of Co and Ni with 0.1 to 1.0% of Fe and an alloy was prepared therefrom as shown in Example 14. In the structure of the alloy obtained by this procedure, a carbide of $M_2C$ type was uniformly dispersed. The properties of our alloy are shown in Table 13:

TABLE 13

| Run No. | $(Mo_{0.7}W_{0.3})C$ (%) | $(Mo_{0.7}W_{0.3})_2C$ (%) | Co (%) | Ni (%) | Amount of Fe in Binder Metal Phase (%) | T.R.S. ($Kg/mm^2$) |
|---|---|---|---|---|---|---|
| 1 | 85 | 5 | 10 | — | 0.1 | 260 |
| 2 | " | " | " | — | 1.0 | 275 |
| 3 | " | " | 6.6 | 3.4 | 0.5 | 300 |
| 4 | " | " | 7.5 | 2.5 | 0.5 | 290 |

In the alloy of the present invention, the toughness can be increased by adding Fe as an additive element to the binder phase consisting of Co and Ni to disperse a carbide of $M_2C$ type well in the alloy.

EXAMPLE 16

(I) WC powder with a particle size of 6 microns was mixed with $Mo_2C$ powder with a particle size of 2 microns and carbon to give a final composition of carbide $(Mo_{0.5}W_{0.5})C$, ball milled by wet process for 30 hours and the mixed powder was reacted at 2000° C. for 1 hour in an $H_2$ stream. The carbide had a carbon content of T.C. 7.81% and F.C. 0.03% and the combined carbon content was near the theoretical value of $(Mo_{0.5}W_{0.5})C$. X-ray diffraction showed that the peak of $Mo_2C$ disappeared and there were the peaks of (Mo, W)C only. However, examination of the cross section of the powder taught that the powder was of a core structure. According to the examination of the peaks at the high angle side, there were two phases separated.

(II) WC powder with a particle size of 1 micron was mixed with $Mo_2C$ powder with a particle size of 2 microns and carbon to give a final composition of carbide $(Mo_{0.5}W_{0.5})C$, to which 0.5% of Co was then added as a diffusion aid. The mixed powder was heated at 2000° C. for 1 hour in an $H_2$ stream, the temperature being lowered to 1400° C., and the product was held at the same temperature for 10 hours. Analysis of the product showed T.C. 7.71%, F.C. 0.05% and Co 0.5%, the carbon content being near the theoretical carbon content. X-ray diffraction showed no separation into two phases, but showed a completely single phase.

Alloys were prepared from the carbides prepared by the above described procedures (I) and (II). Starting materials were weighed to give a composition of (Mo, W)C-15% Co, ball milled by wet process in an organic solvent, dried, compacted and sintered at 1400° C. in vacuum, thus obtaining alloys having the following properties:

TABLE 14

| | Density | Hardness (HRA) | Transverse Rupture Strength ($Kg/mm^2$) |
|---|---|---|---|
| Our Invention (I) | 11.6 | 88.6 | 280 |
| Prior Art (II) | 11.5 | 88.0 | 180 |

In the alloy of the present invention, there are two kinds of MC type phases and a granular $M_2C$ phase dispersed evenly, whereby a high toughness can be imparted while staining the properties of the prior art WC-Co type cemented carbide alloy. On the contrary, the prior art alloy is a uniform solid solution, but lacks toughness.

We claim:

1. A hard alloy comprising a hard phase consisting of at least one compound having a crystal structure of simple hexagonal MC type (M: metal; C: carbon) selected from the group consisting of mixed carbides, carbonitrides and carboxynitrides of molybdenum and tungsten as a predominant component, and a binder phase consisting of iron, cobalt, nickel and chromium, in which a hard phase consisting of a compound of $M_2C$ type, wherein M and C are as defined above, having a crystal structure of the hexagonal type is uniformly dispersed in a proportion of at most 30% by volume based on all the hard phases, said compound of $M_2C$ type being in a granular or globular form with a size of at most 10 microns, and wherein the carbon content in the hard phases of the alloy is in an atomic proportion of 0.98 to 0.8 with respect to the theoretical carbon content of the MC type compound.

2. The hard alloy as claimed in claim 1, wherein a part of the compound of MC type is replaced by a B1 type hard compound.

3. The hard alloy as claimed in claim 2, wherein the B1 type hard compound contains at least one of titanium, zirconium, hafnium, vanadium, niobium, tantalum, chromium, molybdenum and tungsten.

4. The hard alloy as claimed in claim 2, wherein the quantity of the B1 type hard compound replaced is at most 30% by weight.

5. The hard alloy as claimed in claim 1, wherein at least one of the mixed carbides is a solid solution of (Mo, W, Cr)C.

6. The hard alloy as claimed in claim 5, wherein the quantity of Cr is 0.3 to 10% by weight.

7. The hard alloy as claimed in claim 1, wherein a part of the carbon in the carbides forming the hard phases is replaced by at least one of nitrogen and oxygen.

8. The hard alloy as claimed in claim 7, wherein the quantities of nitrogen and oxygen are defined, in connection with the alloy composition, by the relationships:

$$0.005 \leqq \left(1 - \frac{W \text{ atom } \%}{\text{Group IVa, Va, VIa metal atom } \%}\right) \times \left(\frac{N \text{ atom } \%}{\text{Group IVa, Va, VIa metal atom } \%}\right) \leqq 0.5$$

$$0.005 \leqq \left(1 - \frac{W \text{ atom } \%}{\text{Group IVa, Va, VIa metal atom } \%}\right) \times$$

-continued $$\left(\frac{O \text{ atom } \%}{\text{Group IVa, Va, VIa metal atom } \%}\right) \leqq 0.05$$

9. The hard alloy as claimed in claim 1, wherein the binder phase is incorporated in a proportion of 3 to 50% by weight of the alloy composition.

10. The hard alloy as claimed in claim 1, wherein the quantity of iron in the alloy composition is defined by the relationship:

$$0.001 \leqq \frac{\text{Quantity of Iron (weight } \%)}{\text{Quantity of Binder Metal (weight } \%)} \leqq 0.1$$

11. Thee hard alloy as claimed in claim 1, wherein the dispersion of the hard phase consisting of a compound of $M_2C$ type is carried out by adding an impurity element to the binder phase.

12. The hard alloy as claimed in claim 11, wherein the impurity element is at least one of beryllium, magnesium, calcium, boron, silicon, phosphorus, manganese, iron and rhenium.

13. The hard alloy as claimed in claim 11, wherein the impurity element is added in a proportion of 0 to 3% by weight.

14. The hard phase as claimed in claim 1, wherein the dispersion of the hard phase consisting of a compound of $M_2C$ type is carried out by controlling the temperature during the sintering.

15. The hard alloy as claimed in claim 1, wherein at least one of manganese, rhenium, copper, silver, zinc and gold is incorporated in the binder phase to make the alloy non-magnetic.

16. The hard alloy as claimed in claim 1, wherein the hard phase consisting of a compound of MC type comprises two or more simple hexagonal phases differing in the ratio of Mo/W.

* * * * *